US008622589B2

(12) United States Patent
Chen et al.

(10) Patent No.: US 8,622,589 B2
(45) Date of Patent: Jan. 7, 2014

(54) LED LIGHTING DEVICE

(75) Inventors: Jen-Shyan Chen, Hsinchu (TW); Chung-Jen Lin, Taipei (TW); Hsian-Lung Tan, Taoyuan County (TW)

(73) Assignee: Neobulb Technologies, Inc., Bandar Seri Begawam (BN)

( * ) Notice: Subject to any disclaimer, the term of this patent is extended or adjusted under 35 U.S.C. 154(b) by 0 days.

(21) Appl. No.: 13/056,842

(22) PCT Filed: Feb. 8, 2010

(86) PCT No.: PCT/CN2010/000174

§ 371 (c)(1), (2), (4) Date: Jan. 31, 2011

(87) PCT Pub. No.: WO2011/094901

PCT Pub. Date: Aug. 11, 2011

(65) Prior Publication Data

US 2013/0010479 A1 Jan. 10, 2013

(51) Int. Cl.

| | |
|---|---|
| ***B60Q 1/06*** | (2006.01) |
| ***F21V 13/10*** | (2006.01) |
| ***F21V 29/00*** | (2006.01) |

(52) U.S. Cl.

USPC ..... 362/373; 362/294; 362/363

(58) Field of Classification Search

None

See application file for complete search history.

(56) References Cited

U.S. PATENT DOCUMENTS

| | | | | |
|---|---|---|---|---|
| 2006/0227558 | A1* | 10/2006 | Osawa et al. | 362/351 |
| 2009/0135604 | A1* | 5/2009 | Chen | 362/294 |
| 2009/0225540 | A1* | 9/2009 | Chen | 362/231 |
| 2009/0256459 | A1* | 10/2009 | Liu | 313/12 |
| 2010/0177522 | A1* | 7/2010 | Lee | 362/373 |
| 2010/0207502 | A1* | 8/2010 | Cao et al. | 313/46 |
| 2010/0319756 | A1 | 12/2010 | Chen et al. | |

FOREIGN PATENT DOCUMENTS

| | | | |
|---|---|---|---|
| CN | 1874015 | A | 12/2006 |
| CN | 101294698 | A | 10/2008 |
| WO | WO-2009111908 | A1 | 9/2009 |

OTHER PUBLICATIONS

Official Letter dated Oct. 9, 2012 from Chinese Patent Office for corresponding Chinese Patent Application No. 201010108581.2.

* cited by examiner

*Primary Examiner* — Britt D Hanley
(74) *Attorney, Agent, or Firm* — Patterson & Sheridan, LLP

(57) ABSTRACT

The invention discloses a LED light source, comprising a control circuit module, a shell, an energy conversion component, a heat pipe, and a cooling component. The shell comprises a dome and a side wall, and the shell contains the control circuit module. The energy conversion component comprises a substrate, a substrate holder, and at least a LED, wherein the LED is disposed on the substrate, the substrate is connected to the substrate holder, and the substrate holder is coupled to the control circuit module to drive the energy conversion component. The heat pipe comprises a flat part, an extension part, and a contact part, wherein the substrate and the substrate holder of the energy conversion component are disposed on the flat part; the extension part, disposed inside the shell, extends toward a direction. The cooling component comprises a plurality of fins, wherein the fins contacts the contact part respectively. The control circuit module is disposed between the energy conversion component and the cooling component.

14 Claims, 6 Drawing Sheets

LED LIGHTING DEVICE

BACKGROUND OF THE INVENTION

1. Field of the Invention

The present invention relates to an LED light source, and more particularly, to an LED light source having a bulb-like exterior, wherein a control module circuit can be disposed inside the LED light source.

2. Description of the Prior Art

With the development of semi-conductor light emitting devices, a light-emitting diode (LED), which has several advantages such as power save, seismic resistance, quick reaction, and so on, becomes a new light source. In order to raise the intensity of light, high-power LED has been used as the light source in many illumination products. Although high-power LED can provide stronger light, it may also cause other problems related to heat dissipation. For example, if the heat generated by the LED cannot be dissipated in time, the LED will suffer from "heat shock" which may affect the luminous efficiency and reduce the work life of the LED.

The heat-dissipating component of traditional LED light source usually dissipates the heat with a plurality of fins, wherein the fins have to be attached to a carrier which carries the LED to achieve higher heat-dissipating efficiency. However, the size of the fins used for high-power LED is usually large, and the utility of space of the LED light source applied high-power LED will be limited if the fins are required to be attached to the carrier directly.

Additionally, when a control circuit is disposed inside the LED light source, it is difficult to form the exterior of the LED light source with a shape of light bulb while considering the heat-dissipating issue. Thus, the size of the LED light source may not fit the socket or the holder of traditional light bulb, and the traditional light bulb may therefore not easy to be replaced with the LED light source.

Therefore, it is necessary to provide an LED light source which could make full use of space inside the device by disposing the fins properly, that is, the LED light source can dissipate heat by the fins which are not limited to contact the carrier directly for solving the above-mentioned problem.

SUMMARY OF THE INVENTION

A scope of the invention is to provide an LED light source which can keep its control module circuit away from being heated, and the control module circuit can be contained inside the LED light source. Moreover, the LED light source can have a bulb-like exterior to replace the traditional light bulb.

According to an embodiment of the invention, the invention discloses a LED light source, comprising a control circuit module, a shell, an energy conversion component, a heat pipe, and a cooling component. The shell comprises a dome and a side wall, and the shell contains the control circuit module. The energy conversion component comprises a substrate, a substrate holder, and at least a LED, wherein the LED is disposed on the substrate, the substrate is connected to the substrate holder, and the substrate holder is coupled to the control circuit module to drive the energy conversion component. The heat pipe comprises a flat part, an extension part, and a contact part, wherein the substrate and the substrate holder of the energy conversion component are disposed on the flat part; and the extension part, disposed inside the shell, extends toward a direction. The cooling component comprises a plurality of fins, wherein the fins contacts the contact part respectively. The control circuit module is disposed between the energy conversion component and the cooling component.

In another embodiment of the invention, the cooling component has a space, and the contact part is disposed inside the space and contacts the fins, and the heat pipe penetrates the control module circuit. Moreover, the cooling component has a first cooling part and a second cooling part, and the space is formed by the first cooling part and the second cooling part. Besides, the first cooling part is engaged with the second cooling part by at least a screw or a hook for fixing the contact part inside the space.

In another embodiment of the invention, the shell further comprises a bottom surface, and the cooling component comprises at least a locking hole, collocating with the screw, for locking the cooling component on the bottom surface. Furthermore, the cooling component is engaged with the bottom surface by a hook. Besides, the extension part is covered by an insulation sleeve to reduce the heat radiating from the heat pipe inside the shell. Moreover, the dome is a light homogenizer for homogenizing the light generated by the energy conversion component.

In another embodiment of the invention, the shell further comprises a connector, electrically connected to the control module circuit, for providing the power required by the control module circuit and the energy conversion component. Moreover, the LED light source further comprises a base, electrically connected to the connector, and the base is suitable for being disposed in a socket for electrically connecting to an external power source. Besides, the LED light source can have a bulb-like exterior.

To sum up, the LED light source of the invention can have a fixed exterior with a plurality of LEDs, and the LEDs comprise several types of luminous efficiency for providing different scales of illumination. Further, the LED light source can make full use of space inside the device by disposing the fins properly. Specifically, the control module circuit can be disposed between the energy conversion component and the cooling component, and the LED light source is suitable for any general socket for replacing the traditional light bulb.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
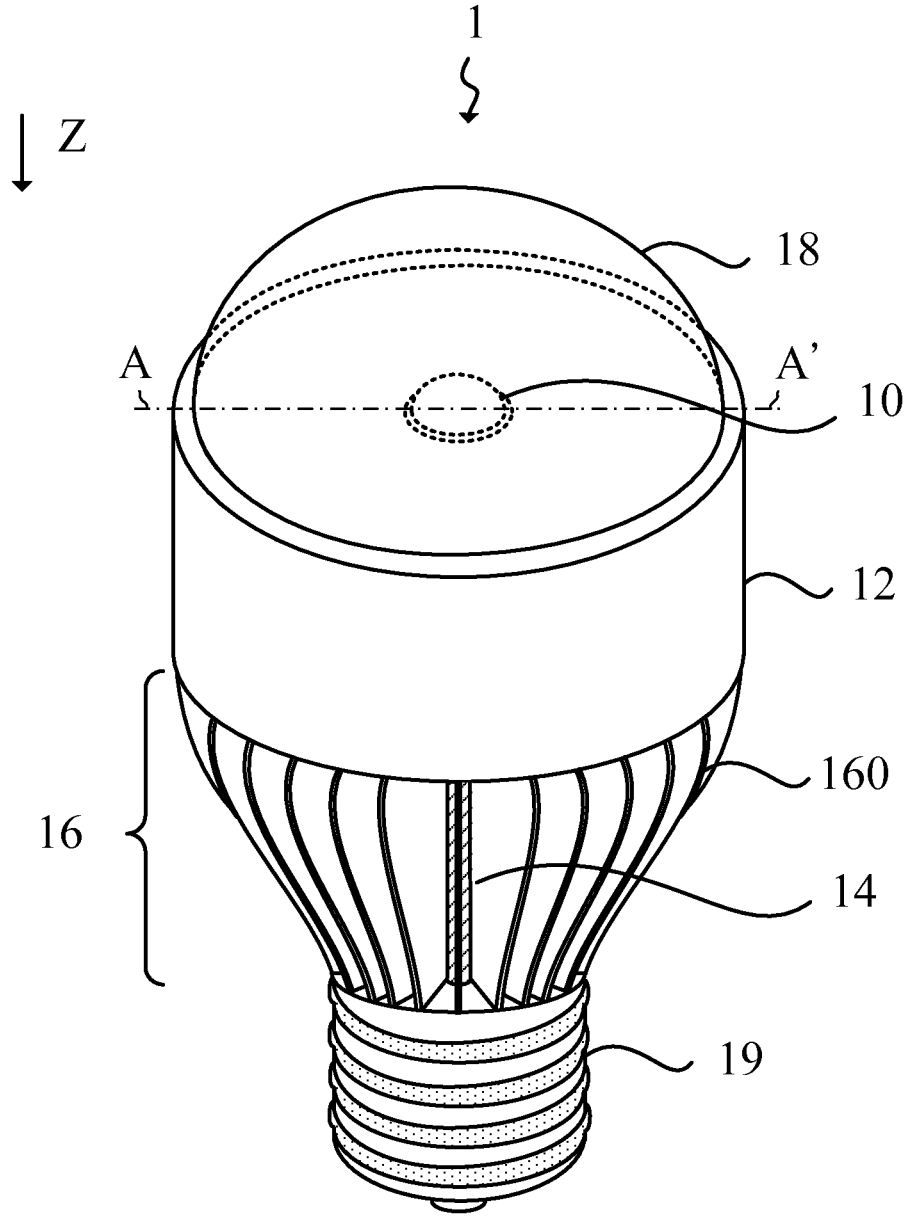
FIG. 1 illustrates a perspective view of the LED light source according to an embodiment of the invention.
Figure 2:
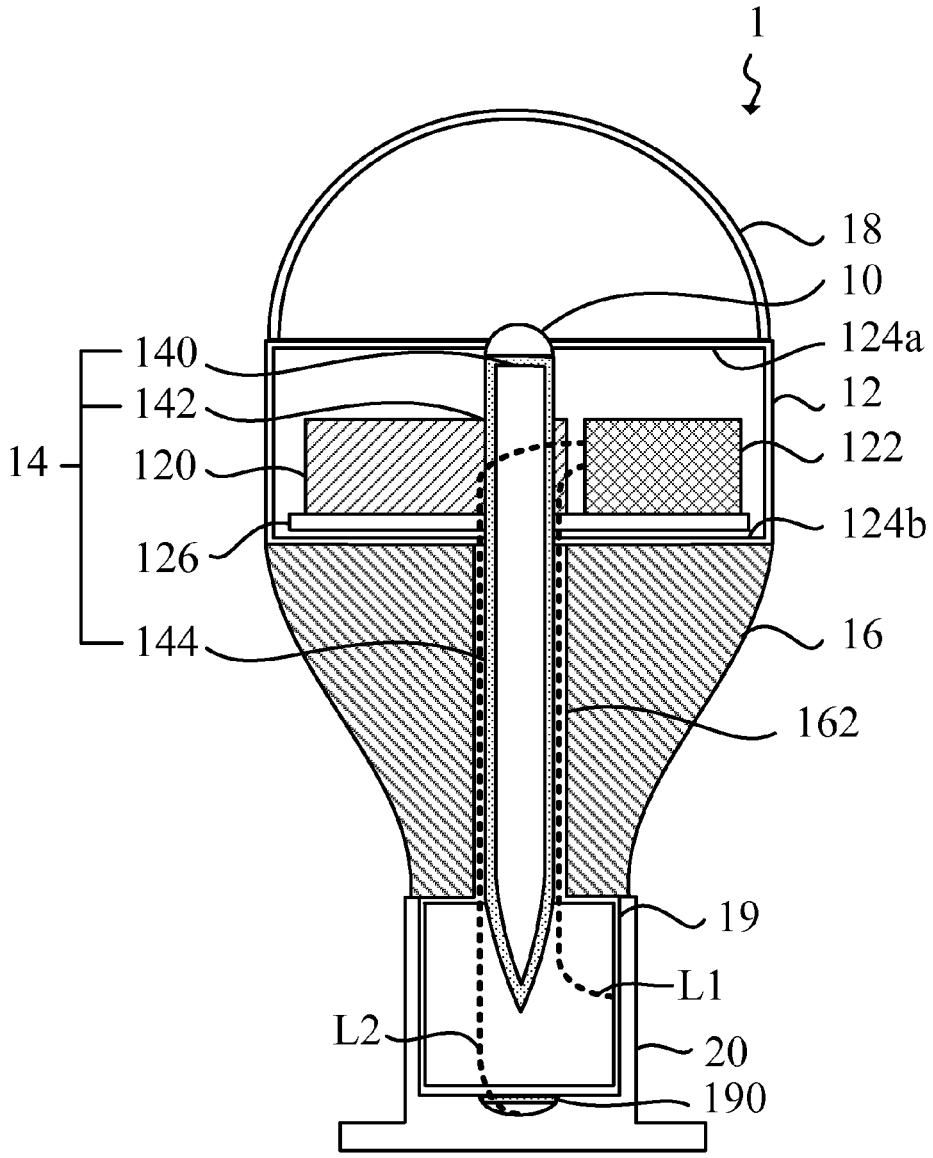
FIG. 2 illustrates a cross section of the LED light source according to an embodiment of the invention.

Please refer to FIG. 1 and FIG. 2. FIG. 1 illustrates a perspective view of the LED light source according to an embodiment of the invention. FIG. 2 illustrates a cross section of the LED light source according to an embodiment of the invention. Specifically, FIG. 2 is a sectional view along Z direction (cross A-A' line) in FIG. 1.

As shown in figures, the LED light source 1 has an exterior which comprises an energy conversion component 10, a circuit container 12, a heat pipe 14, a cooling component 16, a light homogenizer 18, and a base 19. The circuit container 12 comprises an upper surface 124*a* and a lower surface 124*b*. The heat pipe 14 comprises a flat part 140 and a contact part 144. The cooling component 16 comprises a plurality of fins 160. Besides, the exterior can further comprise a shell, wherein the she comprises a dome and a side wall. The dome of the shell corresponds to the light homogenizer 18, and the side wall of the shell corresponds to the side wall of the circuit container 12. Moreover, the shell can further comprise a bottom surface which corresponds to the lower surface 124*b* of the circuit container 12.

The energy conversion component 10 penetrates through the upper surface 124*a*, and the energy conversion component 10 comprises at least one LED for generating the light. In practice, the main purpose of the energy conversion component 10 is to provide the LED for generating the light, and it should not be limited to the means for mounting the LED. For example, the energy conversion component 10 can comprise a substrate and a substrate holder, wherein the LED is disposed on the substrate, and the substrate is connected to the substrate holder for exposing the LED. Specifically, the LED can be formed on the substrate; the LED can be a LED chip, made by the semi-conductor fabrication process, mounting on the substrate; the substrate holder of the energy conversion component 10 can further comprise a first sunken portion and a second sunken portion connected to the first sunken portion, and the substrate is contacted with the flat part 140 of the heat pipe 14 and connected to the second sunken portion, the LED is exposed outside the first sunken portion.

The circuit container 12 has a space between the upper surface 124*a* and the lower surface 124*b*, wherein the space is applied to contain a control module circuit 120. Moreover, the circuit container 12 can further contain a connector 122, wherein the connector 122, electrically connected to the control module circuit 120, provides the power required by the control module circuit 120 and the energy conversion component 10. The control module circuit 120 and the connector 122 can be disposed on a PCB (Printed circuit board). Furthermore, the LED light source 1 comprises a base 19 which is suitable for being mounted on the socket 20, and the base 19 is electrically connected to the connector 122 and an external power source. In practice, the base 19 can further comprise an insulation layer for separating the base 19 into two conducting areas which can be connected to positive and negative poles of the external power source respectively. For example, power line L1 and L2 connect to the positive and the negative poles of the external power source respectively. The control module circuit 120 comprises a through hole, and the heat pipe 14 penetrates the control module circuit 120 through the through hole. Besides, the control module circuit 120 can be a scattering type circuit which is disposed around the heat pipe 14.

The heat-pipe 14 comprises a flat part 140, an extension part 142, and a contact part 144. The flat part 140 contacts the energy conversion component 10. The extension part 142 is disposed inside the circuit container 12 and extending along a direction toward the outside of the energy conversion component 10. The contact part 144 penetrates the lower surface 124*b*. In practice, the heat pipe 14 is a hollow tube which has a capillary structure inside, and materials with high thermal conductivity can be filled in the heat pipe 14 to increase the efficiency of thermal conductivity. Besides, the extension part 142 is inside the circuit container 12, and the circuit container 12 contains several circuits. In order to keep the heat from radiating inside the circuit container 12 through the extension part 142, the extension part 142 can be covered by an insulation sleeve (not shown in figures) to reduce the heat radiating inside the circuit container 12.

The cooling component 16 comprises a plurality of fins 160, each of the fins 160 contacting the contact part 144 of the heat pipe 14. In practice, the cooling component 16 may have a cylindrical exterior, wherein each fin 160 is parallel to the direction which the contact part 144 extends along. Besides, the fins 160 extend toward the outside of the center of the cylinder radially. Furthermore, the cooling component 16 may have a space 162, and each fin 160 contacts the space 162. The contact part 144 of the heat pipe 14 can be contained in the space 162 to contact those fins 160. To be noticed, the exterior of the cooling component 16 is not limited to the cylinder, and the fins 160 can be perpendicular to the direction which the contact part 144 extends along, wherein the fins 160 can be stacked to form a rectangular cube. Moreover, each of the fins 160 can have a through hole, wherein the contact part 144 penetrates those through holes to contact those fins 160.

As mentioned above, the cooling component 16 can comprise at least a locking hole, collocating with the screw, for locking the cooling component 16 on the lower surface 124*b* of the circuit container 12. In practice, the cooling component 16 is not limited to lock the lower surface 124*b* by the screw, and the cooling component 16 can be engaged with the lower surface 124*b* by a hook.

The light homogenizer 18 is disposed on the outside of the upper surface 124*a*, and the energy conversion component 10 is disposed between the light homogenizer 18 and the upper surface 124*a*. The light homogenizer 18 is applied to diffuse the light generated by the energy conversion component 10. In practice, the light homogenizer 18 can be fixed on the upper surface 124*a* by collocating with the screw or the hook. Additionally, the light homogenizer 18 can has, but not limited to, a flat surface or a curved surface. Take this embodiment for example, the light homogenizer 18 has the curved surface to make the light generated by the energy conversion component 10 penetrate the media of the light homogenizer 18 easier. Specifically, the curved surface can reduce the total reflection of the light by decreasing its incident angle, less than the total reflection angle, and the lumen penetrating the light homogenizer 18 can be increased.

Generally, the LED light source 1 can have a bulb-like exterior. The circuit container 12 can be disposed between the energy conversion component 10 and the cooling component 16, and the control module circuit 120 can be disposed inside the LED light source 1. Thus, traditional light bulbs cannot be replaced with the LED light source 1.

On the other hand, in order to fix the contact part 144 of the heat pipe 14 inside the space 162 of the cooling component 16 stably, the cooling component 16 can be further divided into two half-parts, wherein the two half-parts, forming the space 162, tightly connect to each others to fix the contact part 144 inside the space 162. For example, the cooling component 16 can comprise a first cooling part 16*a* and a second cooling part, and the space 162 is formed by the first cooling part 16*a* and the second cooling part. The first cooling part 16*a* of the cooling component 16 is shown as following figures.

Figure 3A:
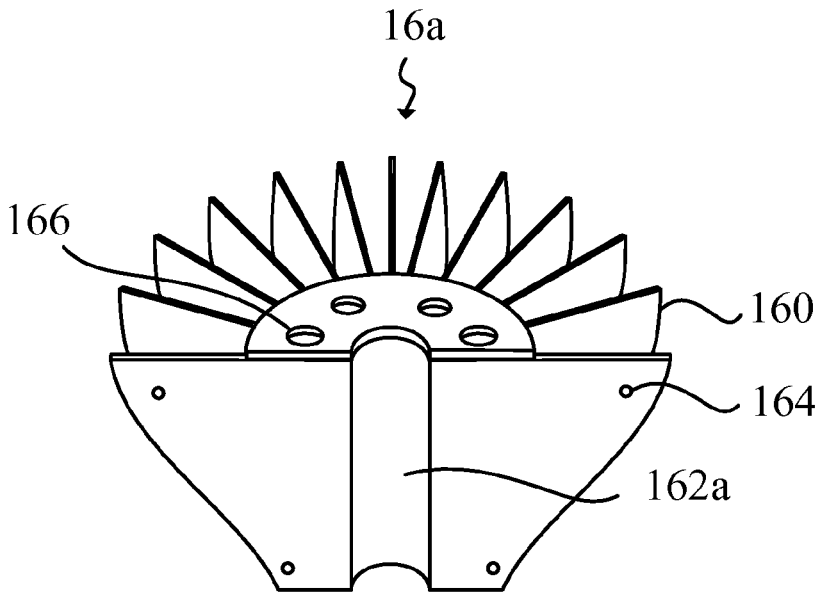
FIG. 3A illustrates a perspective view of the first cooling part according to an embodiment of the invention.

Please refer to FIG. 2 and FIG. 3A. FIG. 3A illustrates a perspective view of the first cooling part according to an embodiment of the invention. As shown in figures, the first cooling part 16*a* comprises a groove 162*a* and a plurality of fins 160. In practice, the groove 162*a* of the first cooling part 16*a* collocates with the corresponding groove of the second cooling part (not shown in figures) to form the space 162 for containing the heat pipe 14. Besides, the first cooling part 16*a* and the second cooling part can comprise several screw holes 164 to lock each other with screws for clamping the heat pipe 14.

Figure 3B:
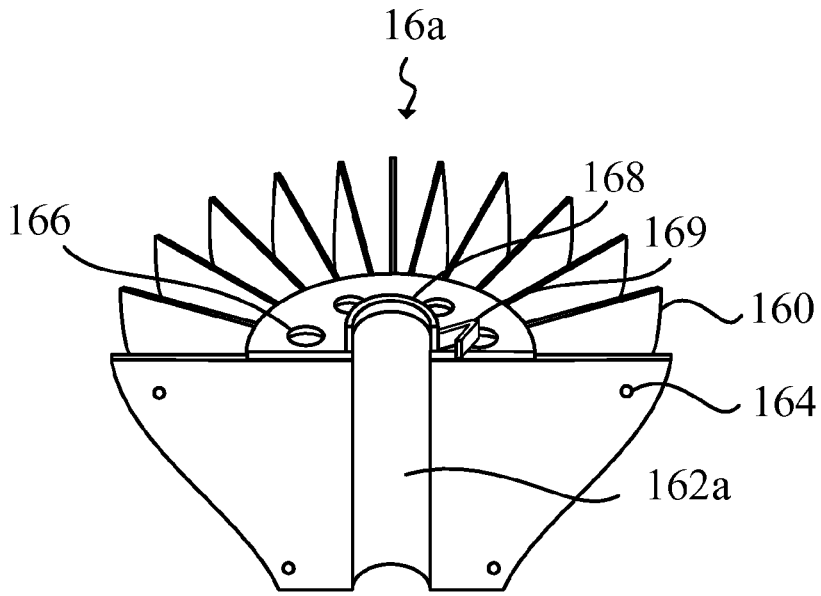
FIG. 3B illustrates a perspective view of the first cooling part according to another embodiment of the invention.

For example, Please refer to FIG. 3B. FIG. 3B illustrates a perspective view of the first cooling part according to another embodiment of the invention. As shown in FIG. 3B, the first cooling part 16*a* and the second cooling part can have a convex part 168 respectively, and the convex part 168 comprises a hook 169, wherein the hook 169 can lock the first cooling part 16*a* and the second cooling part to clamp the heat pipe 14 tightly. In practice, the first cooling part 16*a* and the second cooling part can further comprise the hook and a recess corresponding to the hook to lock each other tightly. To be noticed, the convex part 168 and the hook 169 can be considered as an example, wherein the hook 169 can be disposed on any other proper place to lock the first cooling part 16*a* and the second cooling part.

In addition, the first cooling part 16*a* and the second cooling part can have some locking holes 166 collocating with the screws to lock the first cooling part 16*a* and the second cooling part on the lower surface 124*b* of the circuit container 12. In practice, the first cooling part 16*a* and the second cooling part can be engaged with the lower surface 124*b* by the screws or at least one hook.

In general, the energy conversion component can collocate with a carrier or other proper devices to be disposed inside the LED light source stably. Further, the energy conversion component can contact the flat part of the heat pipe by through the carrier to increase the heat-dissipating efficiency. There are several embodiments are shown thereinafter that further illustrate the structures between the energy conversion component and the carrier.

Figure 4A:
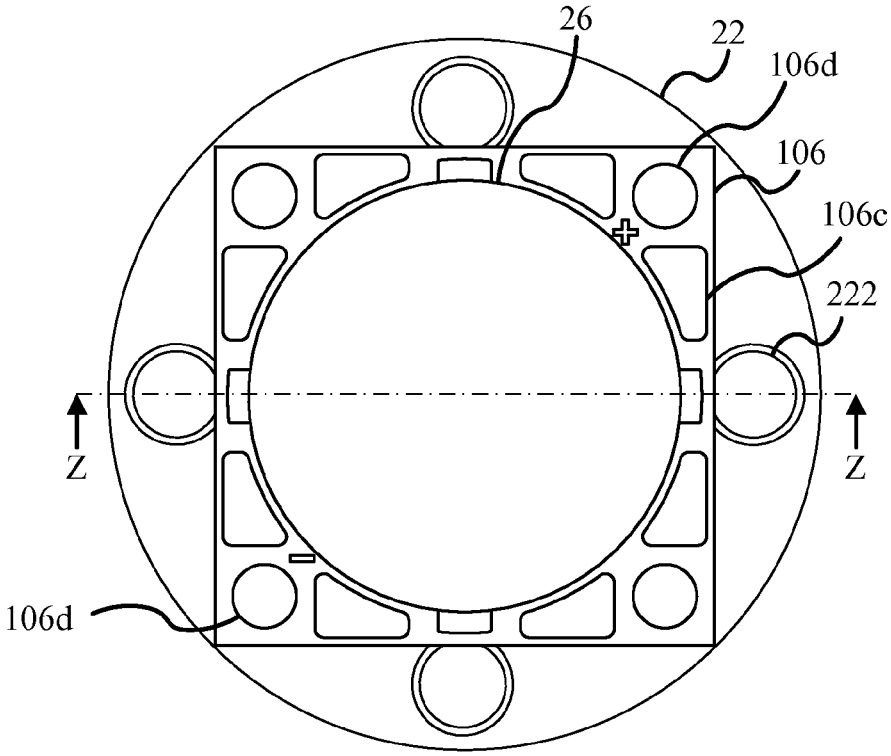
FIG. 4A illustrates a top view of the energy conversion component and the carrier according to an embodiment of the invention.
Figure 4B:
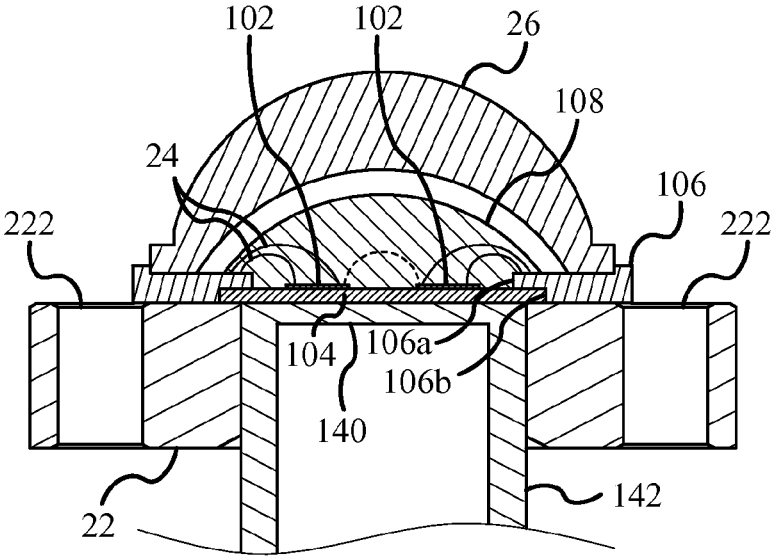
FIG. 4B illustrates a sectional view of the energy conversion component, the carrier, and a part of the heat pipe along Z-Z line in FIG. 4A.

Please refer to FIG. 4A and FIG. 4B. FIG. 4A illustrates a plane view of the energy conversion component and the carrier of the LED light source. FIG. 4B illustrates a cross section of the energy conversion component, the carrier, and a part of the heat-pipe along line Z-Z in FIG. 4A. According to the first preferred embodiment, the energy conversion component 10 includes light-emitting semiconductor structures 102, a substrate 104 and a substrate holder 106. The light-emitting semiconductor structures 102, known as the first LEDs and the second LEDs above, are disposed on the substrate 104. The substrate holder 106 includes a first sunken portion 106*a* and a second sunken portion 106*b* connected to the first sunken portion 106*a*. The substrate 104 contacts with the flat part 140 and is connected to the second sunken portion 106*b*, and the light-emitting semiconductor structures 102 are exposed out of the first sunken portion 106*a*. The carrier 22 has a through hole 222 for containing wires, wherein the wires can provide the power to the energy conversion component 10.

The light-emitting semiconductor structure 102 is an independent sunken portion chip and it is fixed (die bonded) on the substrate 104. The light-emitting semiconductor structure 102 is wired to inner electrodes of the substrate holder 106 with metal wires 24 and then the light-emitting semiconductor structure 102 is electrically connected to the control circuit through wires welded to outer electrodes 106*c* which is connected to the inner electrodes on the substrate holder 106 (please also refer to FIG. 2). The light-emitting semiconductor structure 102 and metal wires 24 are fixed or sealed on the substrate 104 by a packing material 108. The substrate holder 106 is fixed on the carrier 22 by screwing screws through holes 106*d* to the carrier 22. The packing material 108 is also able to adjust light. If the contour of the packing material 108 is protrusive as shown in FIG. 4B, the packing material 108 is able to converge light.

According to the first preferred embodiment, the energy conversion component 10 includes a lens 26 disposed on the substrate holder 106. The lens 26 is able to converge light, but not limited to it. With a proper design on the curvatures of two sides of the lens 26, the lens 26 is able to converge or scatter light for satisfying different optical adjustment requirements. In practical application, the optical adjustment effect of the LED light source also needs to consider optical characters of a lens structure of the optical modulator. What is remarkable is that the lens structure of the optical modulator is not limited to a convex lens. For example, there can further comprise a recess at the middle of the lens structure and thus light is converged to become a ring shape roughly by the lens structure.

Please refer to FIG. 4A and FIG. 4B. Additionally, the substrate holder 106 could be formed by imbedding a lead frame of metal into a mold and then injecting liquid crystal plastic into the mold. Therein, the inner electrodes defined on the lead frame are exposed out of the first sunken portion 106*a*, and the outer electrodes 106*c* are exposed out of the substrate holder 106. Additionally, the light-emitting semiconductors 102 could be connected in serial by wiring as shown by the dotted line in FIG. 4B. Meantime, the light-emitting semiconductor structure 102 in FIG. 4B only retains one metal wire 24 to be connected to the substrate holder 106. If there is a circuit on the substrate 104, for example a semiconductor substrate with a circuit formed in process or a circuit board coated with a metal circuit, the light-emitting semiconductor structure 102 could be wired to the substrate 104 and then electrically connected to the substrate holder 106 through the substrate 104. If the substrate 104 is designed not to be a medium for electrical connection, the substrate 104 could be made of a metal material or other materials with high thermal conductivity for raising the thermal conduction efficiency of conducting the heat generated by the light-emitting semiconductor structure 102 to the flat part 140.

Figure 5:
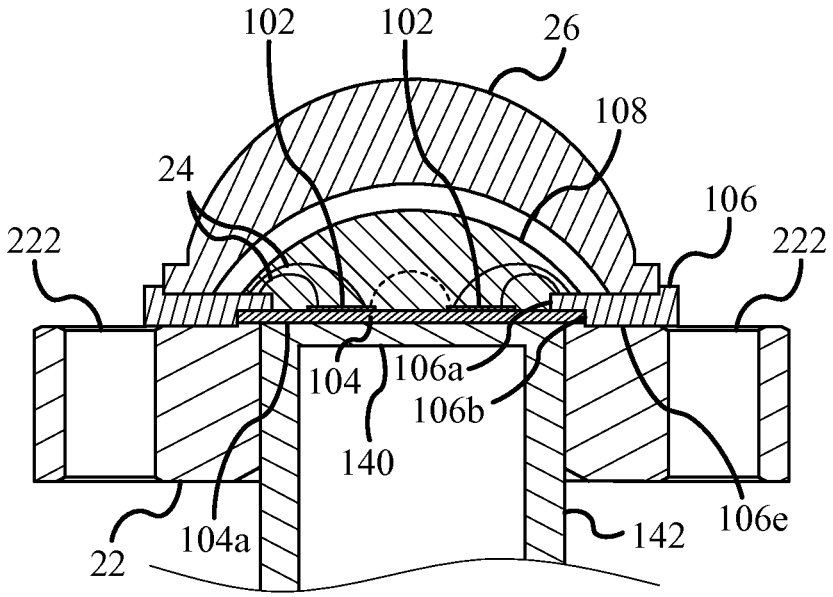
FIG. 5 illustrates a cross section of the energy conversion component, the carrier, and a part of the heat pipe according to an embodiment.

Please refer to FIG. 5. FIG. 5 illustrates a cross section of the energy conversion component 10, the carrier 22, and a part of heat-pipe 24 according to an embodiment. The difference between the FIG. 4A, and FIG. 4B is that the substrate 104 in FIG. 5 is disposed in the second sunken potion 106*b* entirely. Therefore, the bottom surface 106*e* of the substrate holder 106 slightly protrudes out of the bottom surface 104*a* (for contacting with the flat part 140) of the substrate 104. Correspondingly, the flat part 140 protrudes out of the carrier 22 and the protrusive height of the flat part 140 is slightly greater than the concave depth of the bottom surface 104*a* of the substrate 104 for ensuring that the substrate 104 is stuck on the flat part 140 tightly.

Similarly, the flat part 140 could slightly protrude out of the carrier 22 and the bottom surface 106*e* of the substrate holder 106 and the bottom surface 104*a* of the substrate 104 are coplanar. The above purpose for ensuring sticking tightly could also be achieved. In the structure shown in FIG. 4B, if there is a gap between the substrate holder 106 and the flat part 140, a thermal conductive glue could be coated on the bottom surface of the substrate holder 106 or the flat part 140 to be filled with the gap. Of course, in the structure as shown in FIG. 5, the thermal conductive glue could be coated on the bottom surface 106*e* of the substrate holder 106 or the flat part 140 to be filled with the gap formed due to surface roughness of the bottom surface 106*e* or the flat part 140.

Figure 6:
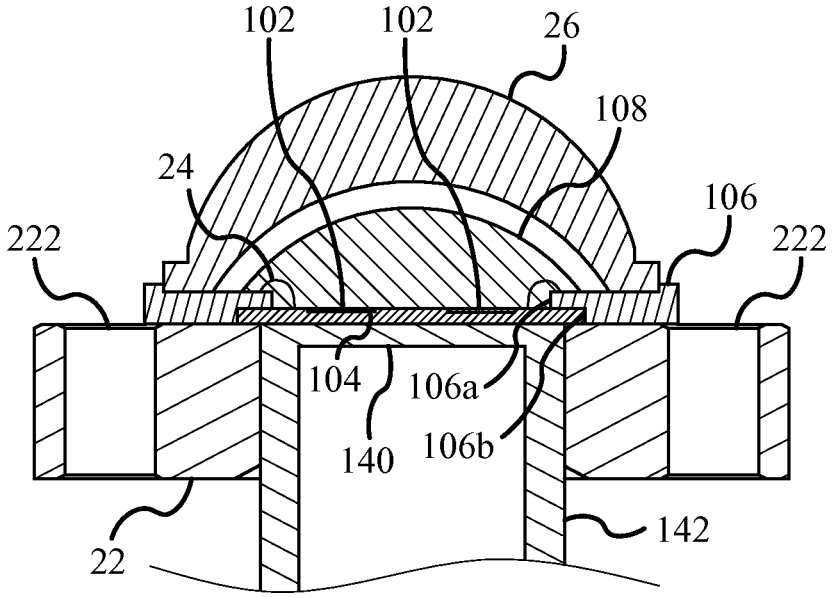
FIG. 6 illustrates a cross section of the energy conversion component, the carrier, and a part of the heat pipe according to another embodiment.

Please refer to FIG. 4B and FIG. 6. FIG. 6 illustrates a cross section of the energy conversion component 10, the carrier 22, and a part of the heat-pipe 24 according to another embodiment. The difference between FIG. 4B and FIG. 6 is that the light-emitting semiconductor 102 in FIG. 6 is formed on the substrate 104 directly; for example, the substrate 104 is a semiconductor substrate (a silicon substrate). Therefore, the light-emitting semiconductor 102 could be integrated to form on the substrate 104 easily in a semiconductor process. Additionally, the electrodes of the light-emitting semiconductor structure 102 formed on the semi-substrate 104 could be integrated on the substrate 104 in advance, so that only two times of wiring are required to the light-emitting semiconductor structure 102. The stability of the fabrication could increase thereby.

Figure 7:
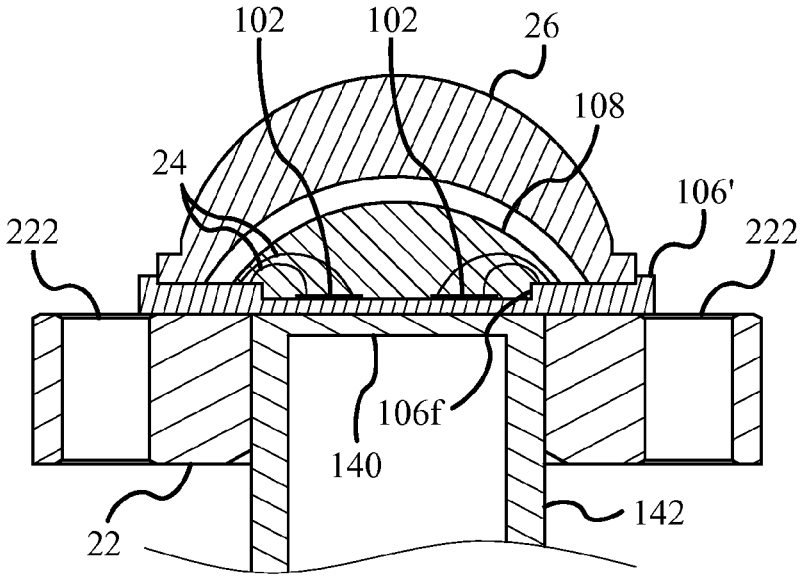
FIG. 7 illustrates a cross section of the energy conversion component, the carrier, and a part of the heat pipe according to another embodiment.

Please refer to FIG. 4B and FIG. 7. FIG. 7 illustrates a cross section of the energy conversion component 10, the carrier 22, and a part of the heat-pipe 24 according to another embodiment. The difference between FIG. 7 and FIG. 4B is that the light-emitting semiconductor structure 102 in FIG. 7 is disposed directly on a substrate holder 106' having a recess 106*f* rather than on the substrate 104 as shown in FIG. 4B. Additionally, in practical application, the substrate holder 106' could be a plate where the light-emitting semiconductor 102 is disposed directly. The description about the energy conversion component 10 in FIG. 4B is also applied here, and it will no longer be explained.

Figure 8:
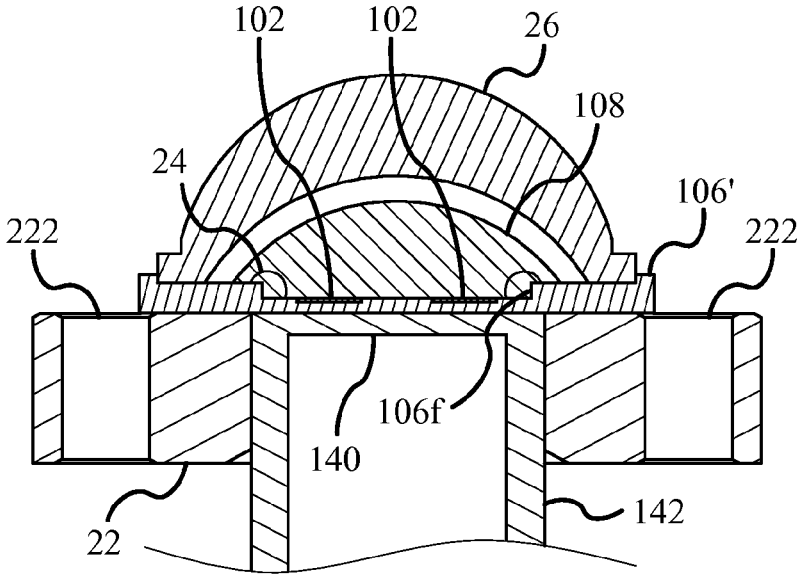
FIG. 8 illustrates a cross section of the energy conversion component, the carrier, and a part of the heat pipe according to another embodiment.

Please refer to FIG. 7 and FIG. 8. FIG. 8 illustrates a cross section of the energy conversion component 10, the carrier 22 and a part of the heat-pipe 24 according to another embodiment. The difference between FIG. 4B and FIG. 8 is that the light-emitting semiconductor structure 102 in FIG. 8 is formed directly on a substrate holder 106'. Of course, in practical application, the substrate holder 106' could be a plate. The description about the energy conversion component 10 in FIG. 6 is also applied here, and it will no longer be explained.

Moreover, each carrier of the LED light source can have a through hole to let a power line penetrate, wherein the control module circuit is electrically connected to the connector by the power line. The connector is further connected to an external power source to obtain the power for the control module circuit to control the energy conversion component, and the connector further provides the power required by the energy conversion component for converting the electric power into light.

To sum up, the LED light source of the invention has a bulb-like exterior and comprises LEDs, and the LED light source can make full use of space inside the device to contain the control module circuit. Further, the heat pipe can dissipate the heat generated by the LED by transmitting the heat to fins. Specially, the extension part of the heat pipe can be covered by the insulation sleeve to greatly reduce the heat taken by the control module circuit inside the circuit container. On the other hand, the invention can collocate with a plurality of cooling components to significantly increase the heat-dissipating efficiency, that is, the heat-dissipating of the LED light source can be greatly enhanced. In other words, with the heat pipe, the heat generated by the LEDs can be dissipated in time, and the LEDs will not suffer from the "heat shock." Accordingly, the luminous efficiency and work life of the LEDs can be increased.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An LED light source, comprising:
control module circuit;
a shell, comprising a dome and a side wall, for containing the control module circuit;
an energy conversion component, disposed inside the shell, comprising a substrate, a substrate holder, and at least a LED, wherein the LED is disposed on the substrate, the substrate is connected to the substrate holder, and the substrate holder is electrically connected to the control module circuit for driving the energy conversion component;
a heat-pipe, comprising a flat part, an extension part and a contact part, wherein the substrate and the substrate holder are disposed on the flat part, and the extension part is disposed inside the shell and extended along a direction;
and a cooling component having a plurality of fins, each of the fins contacting the contact part;
wherein the control module circuit is disposed between the energy conversion component and the cooling component, the cooling component has a space, the contact part is disposed inside the space and contacts the fins, and the heat pipe penetrates the control module circuit.

2. The LED light source of claim 1, further comprising a circuit container for containing the control module circuit, the circuit container comprising an upper surface and a lower surface, the energy conversion component penetrating the circuit container through the upper surface, and the heat pipe penetrating the lower surface.

3. The LED light source of claim 1, wherein the cooling component has a first cooling part and a second cooling part, and the space is formed by the first cooling part and the second cooling part.

4. The LED light source of claim 1, wherein the first cooling part is engaged with the second cooling part by at least a screw or a hook for fixing the contact part inside the space.

5. The LED light source of claim 1, wherein the shell further comprises a bottom surface, and the cooling component comprises at least a locking hole, collocating with at least a screw, for locking the cooling component on the bottom surface.

6. The LED light source of claim 1, wherein the shell further comprises a bottom surface, and the cooling component is engaged with the bottom surface by a hook.

7. The LED light source of claim 1, wherein the extension part is covered by an insulation sleeve to reduce the heat radiating from the heat pipe inside the shell.

8. The LED light source of claim 1, wherein the dome is a light homogenizer for homogenizing the light generated by the energy conversion component.

9. The LED light source of claim 1, wherein the shell further comprises a connector, electrically connected to the control module circuit, for providing the power required by the control module circuit and the energy conversion component.

10. The LED light source of claim 9, further comprising a base, electrically connected to the connector, and the base being capable of disposed in a socket for electrically connecting to an external power source.

11. The LED light source of claim 10, wherein the base is engaged with the cooling component by at least a screw or a hook.

12. The LED light source of claim 1, wherein the substrate holder comprises a first sunken portion and a second sunken portion connected to the first sunken portion, the substrate is contacted with the flat part and connected to the second sunken portion, and the LED is exposed outside the first sunken portion.

13. The LED light source of claim 1, further comprising a carrier, connected to the heat-pipe, and the energy conversion component being fixed on the carrier to contact with the flat part.

14. The LED light source of claim 1, wherein the control module circuit comprises a through hole, and the heat pipe penetrates the control module circuit through the through hole.

* * * * *